US005772039A

United States Patent [19]

Orr et al.

[11] Patent Number: 5,772,039

[45] Date of Patent: Jun. 30, 1998

[54] THEFT-DETERRENT DISPLAY PACKAGING SYSTEM

[75] Inventors: Scott P. Orr, Bolingbrook; Thomas L. Prochut, Darien, both of Ill.

[73] Assignee: Humphreys Inc., Chicago, Ill.

[21] Appl. No.: 764,682

[22] Filed: Dec. 11, 1996

[51] Int. Cl.[6] ..... B65D 73/00; A44B 21/00

[52] U.S. Cl. ..... 206/779; 206/460; 206/495; 206/807; 206/813; 53/139.4; 53/416; 493/384

[58] Field of Search ..... 206/37, 38, 460, 206/495, 477, 775, 779, 783, 807, 813, 732–735, 488; 53/478, 416, 139.4, 138.1; 493/376, 375, 961, 384

[56] References Cited

U.S. PATENT DOCUMENTS

| | | | |
|---|---|---|---|
| 578,843 | 3/1897 | Smith | 206/460 |
| 709,464 | 9/1902 | Broach et al. . | |
| 1,553,827 | 9/1925 | Lee | 206/732 |
| 2,645,340 | 7/1953 | Dow . | |
| 2,996,177 | 8/1961 | Sproull et al. | 206/813 |
| 3,908,827 | 9/1975 | Bemmels et al. | 206/488 |
| 4,154,339 | 5/1979 | Dutra | 206/460 |
| 4,464,552 | 8/1984 | Pawlowski | 206/460 |
| 4,583,641 | 4/1986 | Gelzer | 206/485 |
| 4,664,264 | 5/1987 | Kirk . | |
| 5,018,253 | 5/1991 | Oppenheimer | 206/807 |
| 5,379,886 | 1/1995 | Brauner et al. | 206/216 |
| 5,437,172 | 8/1995 | Lamy et al. | 206/807 |
| 5,546,688 | 8/1996 | Merser . | |

FOREIGN PATENT DOCUMENTS

| | | | |
|---|---|---|---|
| 404898 | 1/1934 | United Kingdom | 206/495 |

*Primary Examiner*—Paul T. Sewell
*Assistant Examiner*—Luan K. Bui
*Attorney, Agent, or Firm*—Crowell & Moring, LLP

[57] ABSTRACT

A packaging system for displaying articles such as wallets in a manner such that the wallets are readily accessible to shoppers, but are relatively difficult to shoplift. The packaging system comprises three main elements: a box, a box insert, and an attachment mechanism which secures the article to the box insert. The box insert is then adhesively attached to the box. In a first embodiment, the article is secured to the box insert using a filament loop. In a second embodiment, the article is attached to the box insert using a flat loop.

23 Claims, 8 Drawing Sheets

FIG. 6A
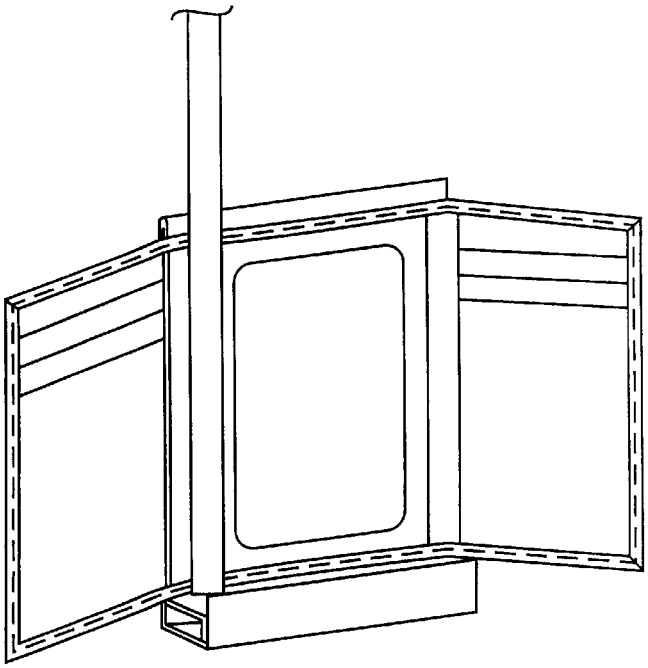
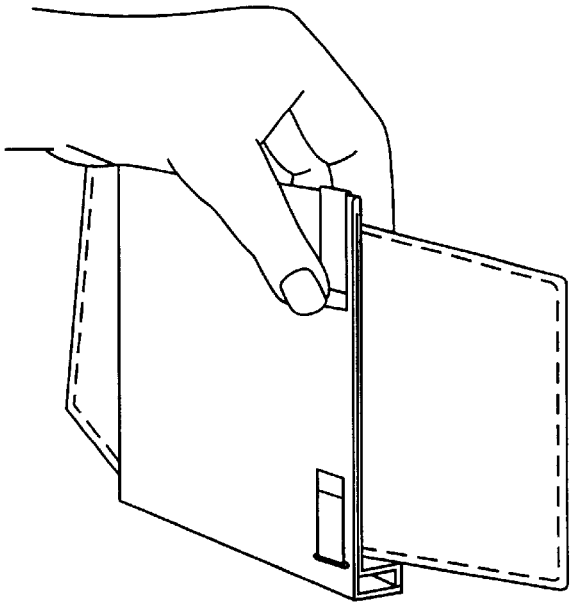
FIG. 6B

THEFT-DETERRENT DISPLAY PACKAGING SYSTEM

BACKGROUND

1. Field of the Invention

The present invention is a theft-deterrent package and system for displaying articles such as wallets at retail outlets.

2. Background of the Invention

Articles such as wallets, key cases, credit card cases, business card cases and other personal goods are conventionally displayed at retail outlets in three ways: as loose articles in a display bin or rack; in open boxes; or in locked display cabinets. Unfortunately, articles displayed in as loose articles or in open boxes can easily be stolen, because they are so small that they can be readily slipped into a shoplifter's pocket, or into a lower-priced box. Articles displayed in locked display cabinets are relatively secure, but are not accessible to shoppers without the assistance of a store clerk.

SUMMARY OF THE INVENTION

The present invention is a packaging system for displaying articles such as wallets, key cases, credit card cases, business card cases and other personal goods in a manner such that the articles are readily accessible to shoppers, but are relatively difficult to shoplift. The present invention will be described using wallets as an example of the personal goods with which the invention may be used. However, it can readily be used with other personal goods, including key cases, credit card cases and business card cases.

As shown in FIGS. 1A and 4, the present invention comprises three main elements: a box, a box insert, and an attachment strip which secures the article to the insert. The box insert is adhesively attached to the box.

When the article is on display, a shopper can easily examine the article without removing it from the box. For example, if the article is a wallet, the shopper can open the wallet, examine each of the compartments of the wallet, and feel the quality of the leather. However, the shopper cannot nondestructively remove the wallet from its packaging system, i.e., the shopper would have to sever the attachment strip or tear the box insert away from the box to steal the wallet.

A shoplifter would have to steal the packaging system to steal the wallet. Shoplifters are deterred from stealing the entire packaging system, because the packaging system is much easier to detect than a wallet by itself. Furthermore, a packaging system found in the shoplifter's possession is convincing "on the spot" evidence that the wallet contained in the packaging system was stolen.

It is the object of the present invention to provide an inexpensive packaging and display system which secures articles such as wallets in their display boxes, yet allows a shopper to fully examine the article.

This object of the present invention is described in greater detail in the detailed description of the invention, the appended drawings, and the attached claims.

DESCRIPTION OF THE DRAWINGS

FIGS. 6A and 6B shows the flat loop as it is used to secure a wallet to a box insert (second embodiment).

DETAILED DESCRIPTION OF THE INVENTION

Figure 1A:
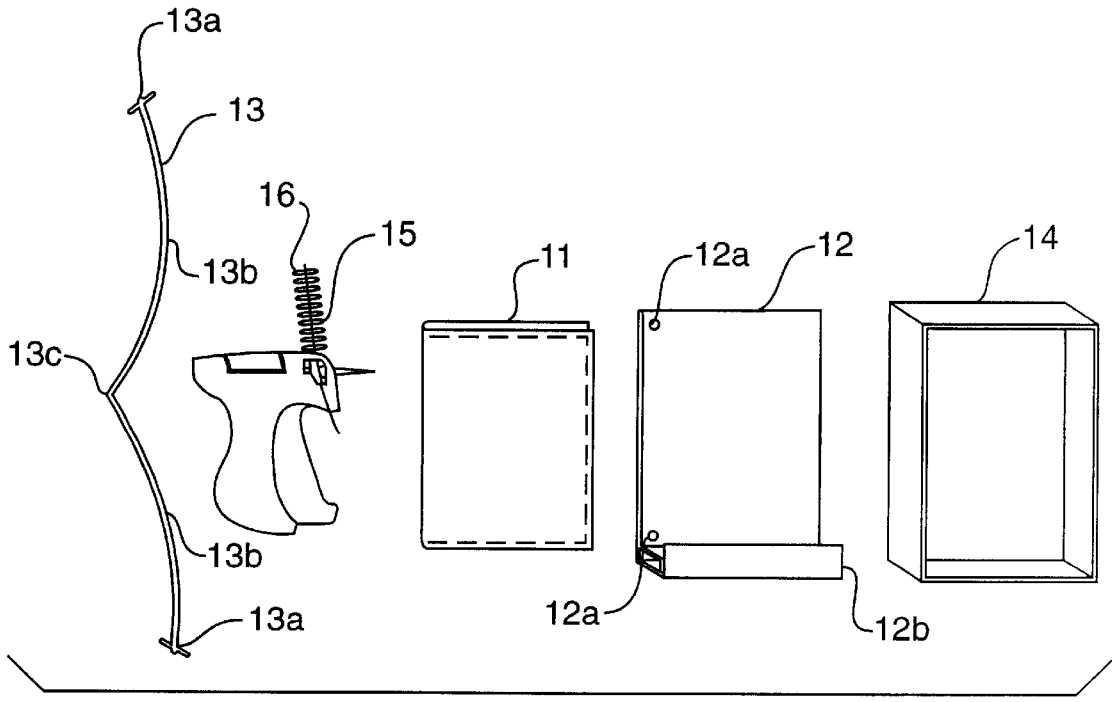
FIG. 1A shows components of the first embodiment of the present invention.
Figure 1B:
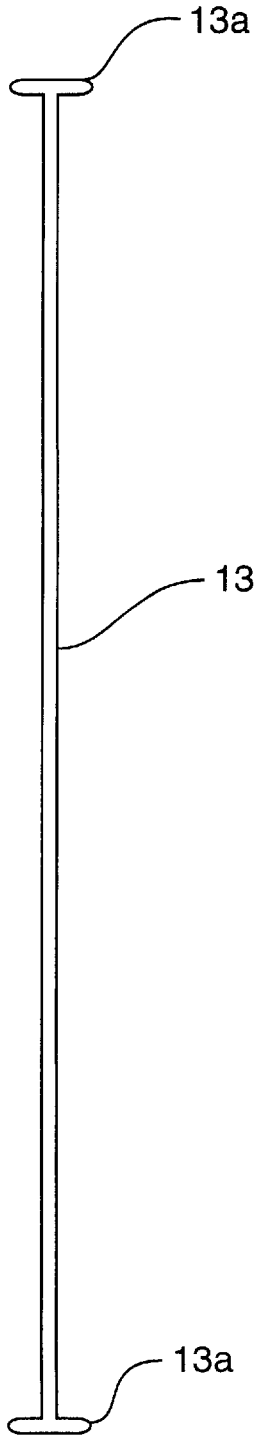
FIG. 1B is a schematic diagram of a filament loop.

FIGS. 1A to 3 illustrate a first embodiment of the present invention. A wallet 11 is attached to a box insert 12 using a filament loop 13 as the attachment strip. Filament loop 13 is generally a monofilament loop made of, e.g., nylon. As shown in FIG. 1A, the filament loop has two T-shaped ends 13*a*, two main portions 13*b* and a central U-shaped bead 13*c*. The central bead 13*c* is not a necessary component of the filament loop, i.e., the filament loop could also be comprised of a single filament extending from a first T-shaped end 13*a* to a second T-shaped end 13*a*, as shown in FIG. 1B.

Figure 2A:
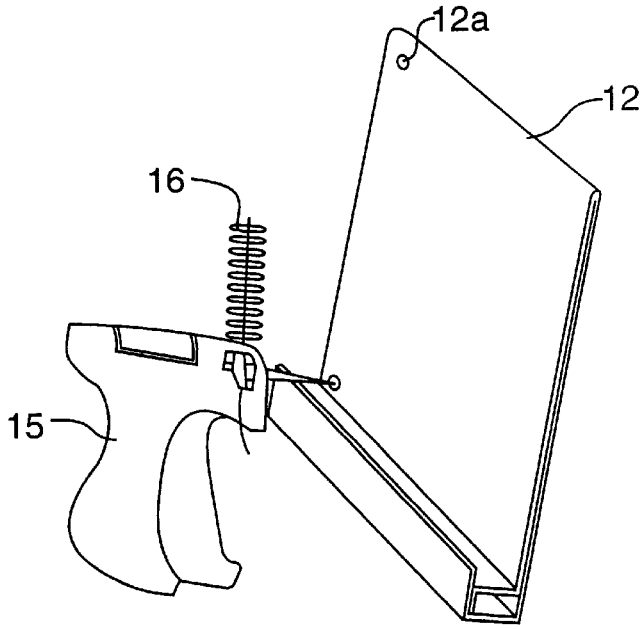
FIG. 2A shows a filament loop as it is inserted into a box insert, using a strip gun.
Figure 2B:
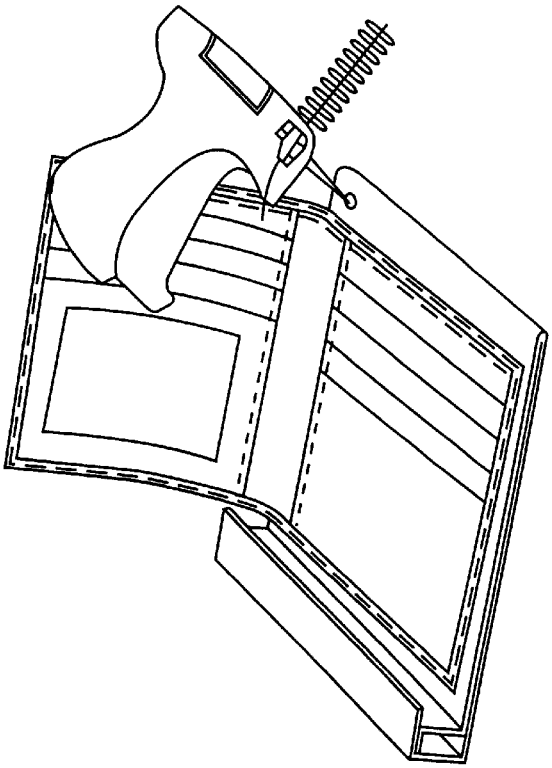
FIG. 2B shows a wallet as it is attached to a box (first embodiment).
Figure 3A:
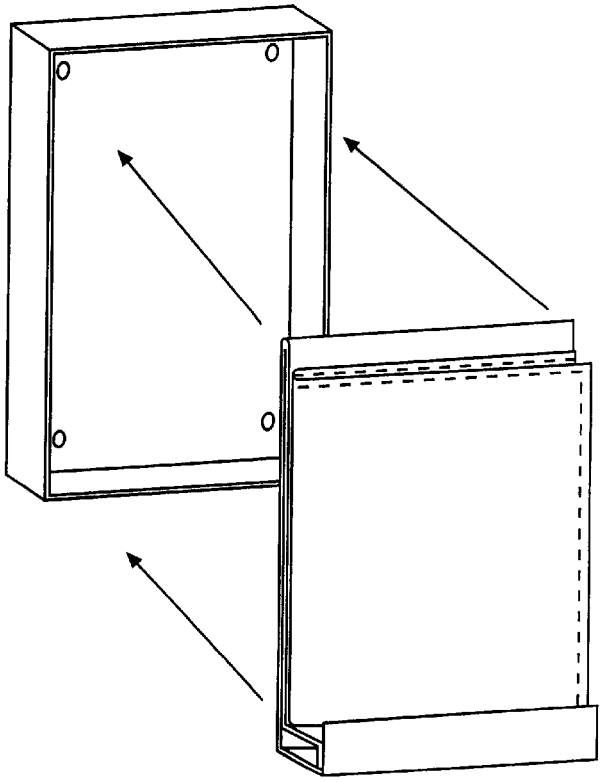
FIGS. 3A and 3B shows a box insert as it is attached to a box (first embodiment).
Figure 3B:
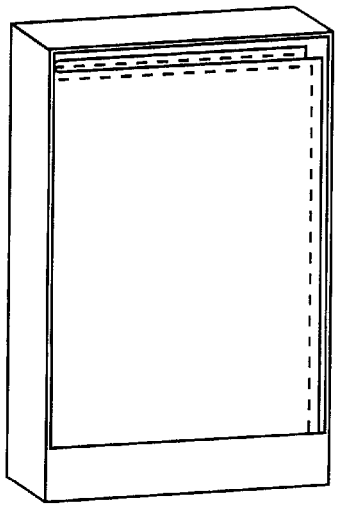
Figure 4:
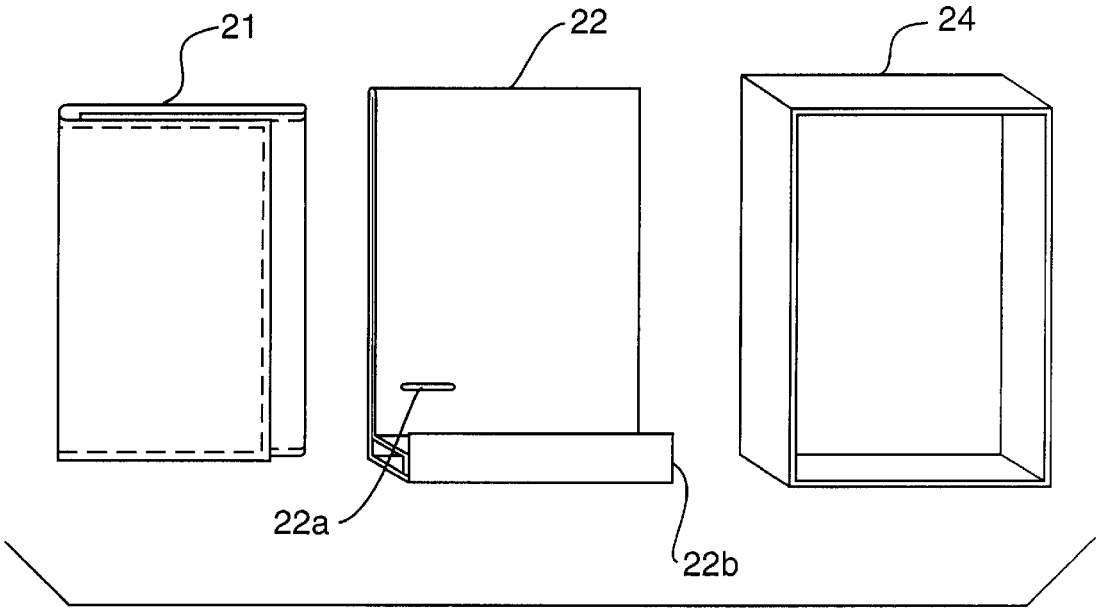
FIG. 4 shows components of the second embodiment of the present invention.

Box insert 12 is a flat, e.g., cardboard sheet dimensioned such that it fits snugly into box 14. Box insert 12 contains two holes 12*a* near each end of one side of the insert. Filament loop 13 is looped around the wallet, then T-shaped ends 13*a* of filament loop 13 are inserted through holes 12*a*. As shown in FIGS. 2A and 2B, filament loops 13 can be inserted into holes 12*a* using a strip gun, which holds a clip of filament loops. As shown in FIG. 3, box insert 12 is then adhesively attached into box 14, such that T-shaped ends 13*a* cannot be pulled back through holes 12*a*.

Box insert 12 also has a "ledge" portion 12*b*, which extends out at a right angle. Ledge portion 12*b* can be used to display trademarks, or provide other information to shoppers. Ledge portion 12*b* also prevents the wallet from sliding out of box 14.

Figure 5A:
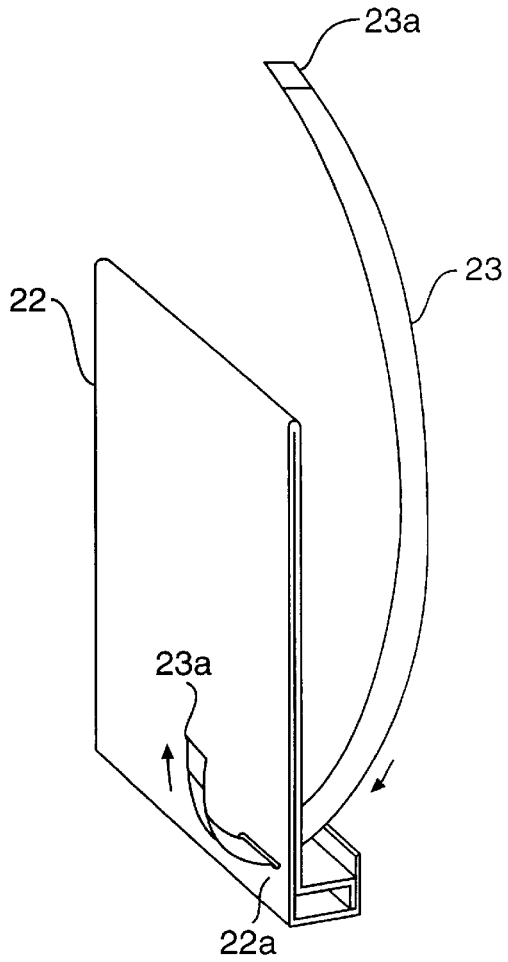
FIGS. 5A and 5B shows a flat loop as it is attached to a box insert (second embodiment).
Figure 5B:
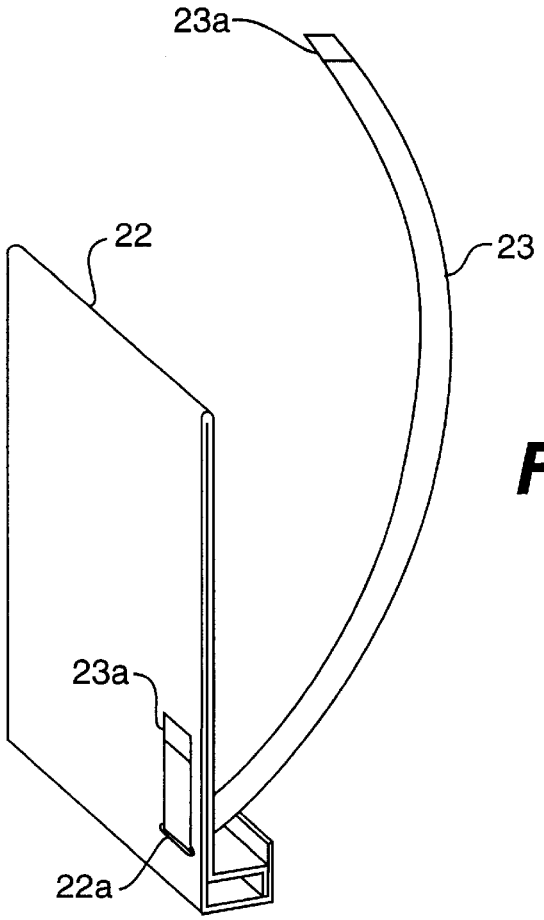

FIGS. 4–7 illustrate a second embodiment of the present invention. A wallet 21 is attached to a box insert 22 using a flat loop 23. As shown in FIG. 2B, flat loop 23 can be fabricated from a single, e.g., ⅜" to ¾" (typically 9/16"), wide polyvinyl chloride strip, typically 0.010" thick, which is looped around wallet 21 and box insert 22. The ends of the flat loop are securely attached to each other and to the back of box insert 22 using, e.g., adhesives. For example, as shown in FIGS. 4–7, the ends of flat loop 23 include adhesive tabs 23*a*. Adhesive tabs 23*a* of flat loop 23 are covered with a release liner (not visible in the Figures). Box insert 22 is a flat, e.g., cardboard sheet similar to box insert 12, except that it has a slot 22*a* instead of two holes similar to holes 12*a*. It is dimensioned such that it fits snugly into box 24. As shown in FIGS. 5–6, one end of flat loop 23 is inserted through a slot 22*a* in box insert 22, and adhesive tab 23*a* is adhesively attached to the back of box insert 22. A wallet (or other article) is placed onto box insert 22, and flat loop 23 is looped around the wallet and over the top of box insert 22, and adhesively attached to the back of box insert 22.

Like box insert 12, box insert 22 also has a "ledge" portion 22*b*, which extends out at a right angle. Ledge portion 22*b* can be used to display trademarks, or provide other information to shoppers.

Figure 7:
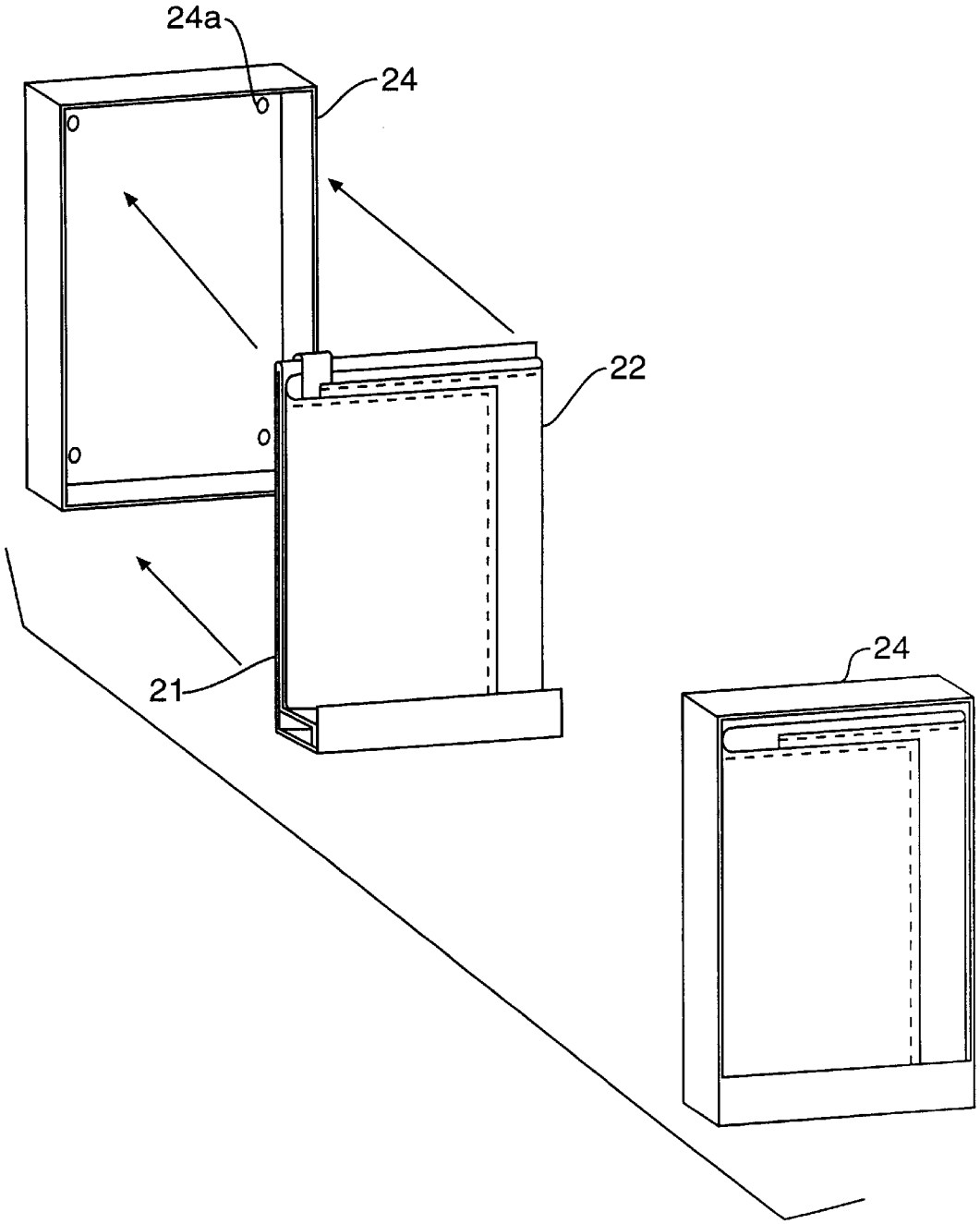
FIG. 7 shows the insert and wallet as they are secured in a box (second embodiment).

As shown in FIG. 7, box insert 22, containing wallet 21, is attached to box 24 by placing four adhesive spots 24*a* at the corners of box 24, inserting box insert 22 into position, and then firmly pressing box insert 22 into position.

The foregoing disclosure of embodiments of the present invention has been presented for purposes of illustration and description. It is not intended to be exhaustive or to limit the invention to the precise forms disclosed. Many variations and modifications of the embodiments described herein will be obvious to one of ordinary skill in the art in light of the above disclosure.

What we claim is:

1. A theft-deterrent packaging system for displaying an article comprising:

(a) a box insert and an article to be displayed, the article having at least two portions movable with respect to each other;

(b) means for securing the article to the box insert;

(c) a box; and (d) means for attaching the box insert to the interior of the box, such that at least one portion of the article can be opened to allow visual and tactile inspection of the at least two portions yet the article cannot be removed from the box without destroying the integrity of the packaging system.

2. The theft-deterrent system of claim 1, wherein the means for securing the article is a filament loop.

3. The theft-deterrent system of claim 2, wherein the filament loop comprises two T-shaped ends, the box insert comprises two holes located near each end of one side of the box insert, and each T-shaped end is inserted into one of the two holes.

4. The theft-deterrent system of claim 3, wherein the filament loop further comprises a central bead.

5. The theft-deterrent system of claim 4, wherein the central bead is U-shaped.

6. The theft-deterrent system of claim 1, wherein the means for securing the article to a box insert is a flat loop.

7. The theft-deterrent system of claim 6, wherein the flat loop comprises two adhesive tabs, with one adhesive tab at each end of the flat loop.

8. The theft-deterrent system of claim 7, wherein the box insert has a front surface and a back surface, and wherein the adhesive tabs are adhesively attached to the back surf ace of the box insert.

9. The theft-deterrent system of claim 7, wherein the box insert comprises a slot located near one end of one side of the box insert, and wherein one end of the flat loop passes through the slot and is adhesively attached to the back surface of the box insert.

10. The theft-deterrent system of claim 6, wherein the flat loop is a vinyl flat loop.

11. The theft-deterrent system of claim 3, wherein the box insert comprises a flat portion and a ledge portion, said ledge portion extending at right angles to the flat portion of the box insert.

12. The theft-deterrent system of claim 2, wherein the box and box insert are dimensioned so as to snugly receive the article, such that the article is prevented from sliding along the box insert.

13. The theft-deterrent system of claim 6, wherein the box and box insert are dimensioned so as to snugly receive the article, such that the article is prevented from sliding along the box insert.

14. A method for securely displaying articles in a packaging system comprising:

(a) securing an article having at least two portions movable with respect to each other to a box insert using an attachment strip;

(b) adhesively attaching the box insert to the interior of a box, such that at least one portion of the article can be opened to allow visual and tactile inspection of the at least two portions yet the article cannot be removed from the box without destroying the integrity of the packaging system.

15. The method of claim 14, wherein the attachment strip is a filament loop.

16. The method of claim 15, wherein the filament loop comprises two T-shaped ends, and wherein the article is secured to the box insert by passing the T-shaped ends through holes located near each end of one side of the box insert.

17. The method of claim 14, wherein the attachment strip is a flat loop.

18. The method of claim 17, wherein the flat loop is secured to the box insert by passing a first end of the flat loop through a slot near one end of one side of the box insert, and adhesively attaching the first end of the flat loop to the box insert.

19. The method of claim 14, wherein the box and box insert are dimensioned so as to snugly receive the article, such that the article is prevented from sliding along the box insert.

20. A theft-deterrent packaging system comprising:

(a) a flat loop having one adhesive tab at each end of the flat loop;

(b) a box insert having a slot located near one end of one side of the box insert; and (c) a box, wherein a first end of the flat loop passes through the slot in the box insert, and is adhesively attached to the box insert, and wherein the box insert fits snugly into the box and is attached to the box.

21. The theft-deterrent system of claim 20, wherein the flat loop is a vinyl flat loop.

22. The theft-deterrent system of claim 20, wherein the box insert comprises a flat portion and a ledge portion, said ledge portion extending at right angles to the flat portion of the box insert.

23. The theft-deterrent system of claim 20, wherein the box and box insert are dimensioned so as to snugly receive the article, such that the article is prevented from sliding along the box insert.

* * * * *